US007654408B2

(12) United States Patent
Bazany

(10) Patent No.: US 7,654,408 B2
(45) Date of Patent: Feb. 2, 2010

(54) CONTAINER WITH LOCKING STRIPS

(75) Inventor: Donald Bazany, Grand Haven, MI (US)

(73) Assignee: Bradford Company, Holland, MI (US)

( * ) Notice: Subject to any disclaimer, the term of this patent is extended or adjusted under 35 U.S.C. 154(b) by 651 days.

(21) Appl. No.: 11/220,216

(22) Filed: Sep. 6, 2005

(65) Prior Publication Data

US 2007/0051728 A1 Mar. 8, 2007

(51) Int. Cl.
*B65D 1/24* (2006.01)
*B65D 25/04* (2006.01)

(52) U.S. Cl. ..... 220/533; 220/532; 220/529

(58) Field of Classification Search ..... 220/529, 220/532, 535, 541, 500, 528, 533, 660, 669, 220/676, 542, 678, 677, 564, 694, DIG. 2, 220/DIG. 15; 206/521.5, 561; D9/456, 434, D9/432, 430, 414; *B65D 1/24, 1/36, 25/06, B65D 25/04, 57/00*

See application file for complete search history.

(56) References Cited

U.S. PATENT DOCUMENTS 1,656,868 A * 1/1928 Davis et al. ..... 312/352
2,081,078 A * 5/1937 Watson ..... 126/373.1
2,366,676 A * 1/1945 Rosenthal ..... 108/180
2,645,127 A * 7/1953 Parks ..... 73/429
2,788,912 A * 4/1957 Simonsen ..... 220/533
2,985,333 A * 5/1961 Kirkman ..... 220/533
3,117,688 A * 1/1964 Walstad et al. ..... 217/7
3,304,142 A * 2/1967 Rockola ..... 312/205
3,612,337 A * 10/1971 Harger ..... 220/541
3,656,786 A * 4/1972 Larson ..... 217/5
4,082,389 A * 4/1978 Stewart ..... 312/258
4,436,215 A * 3/1984 Kleinert et al. ..... 220/533
4,436,354 A * 3/1984 Thorud ..... 312/259
4,499,997 A * 2/1985 Swingley, Jr. ..... 206/509
4,577,773 A * 3/1986 Bitel ..... 220/533
4,593,816 A * 6/1986 Langenbeck ..... 206/425
4,746,015 A * 5/1988 Kaucic ..... 206/708
4,776,477 A * 10/1988 Walker ..... 220/4.28
4,819,795 A * 4/1989 Swaney ..... 206/278
4,826,263 A * 5/1989 Speraw ..... 312/111
4,974,746 A * 12/1990 Dickinson ..... 220/495.09
5,148,942 A * 9/1992 Snook ..... 220/533
5,221,018 A * 6/1993 Pettersson et al. ..... 220/23.4
5,279,232 A * 1/1994 Gollick ..... 108/109
5,584,412 A * 12/1996 Wang ..... 220/500
5,816,484 A * 10/1998 Buchalski et al. ..... 229/117.15
5,971,263 A * 10/1999 Mangano ..... 229/110

(Continued)

FOREIGN PATENT DOCUMENTS

JP 2006008159 A * 1/2006

*Primary Examiner*—Anthony Stashick
*Assistant Examiner*—Robert J Hicks
(74) *Attorney, Agent, or Firm*—Wood, Herron & Evans, LLP

(57) ABSTRACT

The present invention provides for a container that has a base and a pair of side walls extending upwardly therefrom, the side walls having a concave portion and a plurality of apertures. Partitions are positioned between the side walls, each having tabs at each end which extend through the side wall apertures. Locking strips extend through the slots in the tabs of the partitions and are positioned in the concave portions of the container side walls. In an alternative embodiment, each locking strip has a locking member to prevent movement of the locking strip.

22 Claims, 5 Drawing Sheets

U.S. PATENT DOCUMENTS 6,098,829 A * 8/2000 McHenry et al. ..... 220/62.12
6,126,022 A * 10/2000 Merkel ..... 211/135
6,367,651 B2 * 4/2002 Laib et al. ..... 220/676
RE38,707 E 3/2005 Merkel ..... 211/135
2005/0023281 A1 * 2/2005 Bradford ..... 220/528

* cited by examiner

CONTAINER WITH LOCKING STRIPS

FIELD OF THE INVENTION

The present invention relates to containers in general and in particular to containers with partitions for holding products.

BACKGROUND OF THE INVENTION

Traditionally containers, and especially containers with partitions for holding and/or separating products for storage or shipment, were manufactured by placing plurality of partitions in a U-shaped pad which formed the base and side walls of the container. The partitions typically had a pair of slots, positioned at opposite ends of the partition, and rising from the bottom of the partition. These slots were adapted to engage corresponding slots in the side walls of the U-shaped pad, which descended from the top of the side walls of the U-shaped pad. The far end portions of the partitions outside of the slots would then be folded over and sonically welded to the side walls of the U-shaped pad. In this style of container, the exterior dimensions of the container would be increased by twice the thickness of the partition due to the folded over portion of the partition outside each of the side walls of the U-shaped pad. For example, if the partition had a thickness of ¼", after the partition was folded over and attached to the side walls of the U-shaped pad, the overall outside width of the container would be increased by at least ½" to account for the thickness of the partition on either side of the container. When multiple containers were positioned next to one another, as would be the case in shipping or storage, the space between these containers was unusable. Again, in a case where the thickness of a partition was ¼", there would be ½" of space wasted between containers stacked side by side. Such wasted space is obviously undesirable in both a shipping and storage context, as wasted space costs the shipper or the storer additional cost as more space is required to store or ship the same amount of product. In addition, the process of sonically welding the partitions to the outside walls of the U-shaped pad adds cost.

An alternative method of constructing such a container is to use a container with a locking strip which would secure the partitions to the side walls of the U-shaped pad. In this type of container, the partitions did not have slots, but rather had tabs at each end which were adapted to extend through slits in the side walls of the U-shaped pad. The tab on either end of the partition contained an aperture that would allow for a locking strip to slide through and secure the partitions to the U-shaped pad. In a typical example, the tabs would extend approximately ½" from the exterior of the side walls of the U-shaped pad, to allow for adequate space for the locking strip to slide through. While this style of a container had the advantage of eliminating the cost associated with the sonically welding partitions to the sides of the container, it had the disadvantage of increasing the overall outside width of the container, which again increased the amount of space that would be wasted in shipping or storage. For example, if the tab of the partition extended ½" outside the exterior wall of the U-shaped pad, when two containers were put side by side, approximately an inch of unusable or wasted space would result between the containers. This increases shipping or storage costs as more space is needed to ship the same amount of product.

It is an object of the present invention to provide a container that reduces the cost involved in attaching partitions to the side walls of a container. Another object of the invention is to provide a container that minimizes the unusable space between containers when they are positioned next to each other during shipping or storage. It is yet another objective of the present invention to maximize the internal storage space in a particular container while minimizing the exterior dimensions of that container.

SUMMARY OF THE INVENTION

According to one aspect of the present invention, a container is provided that has a base and a pair of side walls extending upwardly from the base. Each side wall has a concave portion which bows inwardly towards the interior of the container. The concave portion has a plurality of parallel side wall apertures. A plurality of partitions are positioned between the side walls of the container, each partition having a first end with a tab and a second end with a tab, the tabs each having a generally linear slot formed therein. The tabs of the partitions extend through the side wall apertures of the container to secure the partitions in a generally vertical orientation. Additionally, a pair of locking strips extend through the slots in the tabs of the partitions and are positioned in the concave portions of the side walls. The locking strips are sandwiched between an exterior surface of the side walls and the tabs to secure the partitions to the side walls.

In an alternative embodiment, the side walls of a U-shaped pad are planarly biased or biased towards a planar orientation, and adapted to inwardly flex in the portion where the side wall apertures are located, to allow a locking strip to pass outside this concave portion in the side wall. In yet further embodiments, the entire side wall may have a concave or bowed configuration or the entire side wall may be adapted to inwardly flex to create a depression or concavity in the plane of the flexible side wall.

In additional embodiments, the locking strip may be further attached or affixed to the side walls by stapling, gluing, heat bonding, or sonic welding. Additionally, in another embodiment, the locking strip may further contain a hinged locking tab or member which is adapted to extend through a locking aperture in one of the side walls and be secured to the side wall or to a partition in any suitable manner.

The present invention provides for a method of making a container comprising the steps of providing a U-shaped member that has a base and a pair of side walls extending upwardly therefrom. In at least one embodiment, each side wall has a concave portion, the concave portion having a plurality of side wall apertures. The method further provides for positioning a plurality of partitions between opposed side walls, each partition having a first end with a tab and a second end with a tab, the tabs each having a slot. The method further provides for inserting the tabs of the partitions in the side wall apertures and sliding a locking strip through the slots in the tabs whereby the locking strip is positioned in the concave portions of a side wall, and is sandwiched between the exterior surface of the side wall and the tabs.

The above and other objects and advantages of the present invention shall be made apparent from the accompanying drawings and the brief description thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF THE INVENTION

Figure 1:
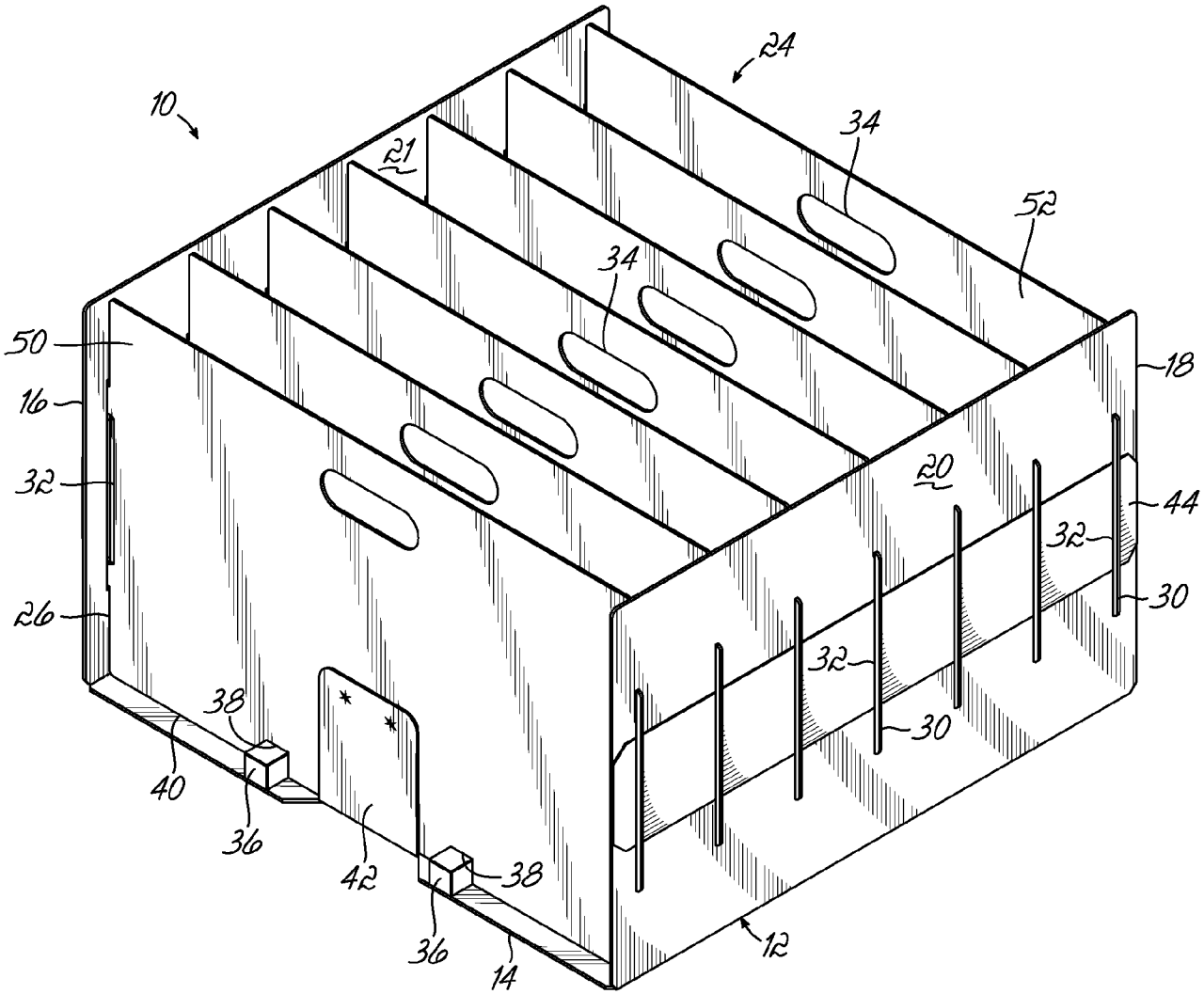
FIG. 1 is a perspective view of an assembled preferred embodiment of the container of the present invention.

Referring to the figures, and particularly to FIG. 1, the container 10 for holding product is comprised of a generally U-shaped pad 12 which has a base 14 and a pair of side walls 16, 18 extending from the base 14. These side walls 16, 18 have an exterior surface 20 and an interior surface 21. Additionally, the side walls 16, 18 have a plurality of side wall apertures 22, seen perhaps more clearly in FIG. 2, which are generally positioned opposite one another in the respective side walls 16, 18.

Figure 2:
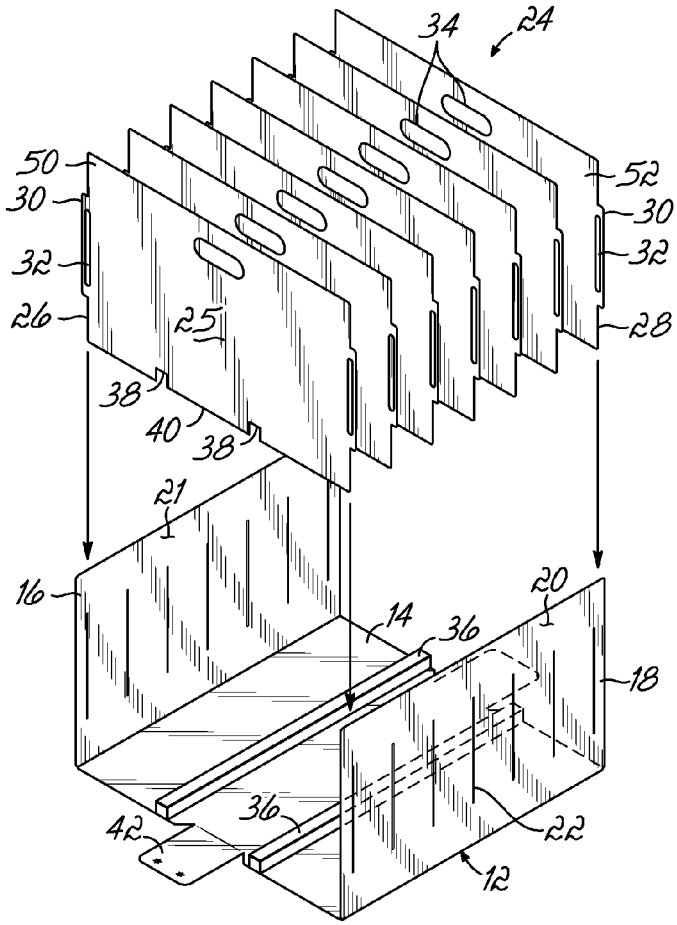
FIG. 2 is a perspective view of the container shown in FIG. 1 showing the positioning of partitions between the side walls of the container.

In one embodiment of the container 10 shown in FIG. 1, a plurality of partitions 24 are positioned between the side walls 16, 18 of the container 10. As shown more clearly in FIG. 2, each partition 24 is generally rectangular and has a first end portion 26, a second end portion 28. Each end portion 26, 28 has a tab 30 extending outwardly from each respective end portion. Each tab 30 further contains a slot, aperture or slit 32. As shown in FIG. 2, the partitions 24 are positioned between the side walls 16, 18 of the container 10 and the tabs 30 extend through the apertures 22 in the side walls 16, 18 of the container 10.

As shown in FIGS. 1-4, each partition 24 may have a handle 34. Although one configuration of handle 34 is illustrated, any like handle mechanism known by those skilled in the art could be utilized to manipulate a partition 24. As also shown in FIGS. 1-4, the base 14 of the container 10 may further contain one or more rails 36 which can be utilized to further guide and position the partitions 24. As shown, each partition 24 has a pair of corresponding notches 38 in the lower end 40 of the partition 24 which are adapted to engage or rest upon the rails 36. The base member 14 of the U-shaped pad 12 further may contain a flap 42 which may be folded and attached or affixed to the partition 24 by staples, glue, heat bonding, sonic welding, or like method of attachment to provide additional support and rigidity to the container 10.

Figure 3:
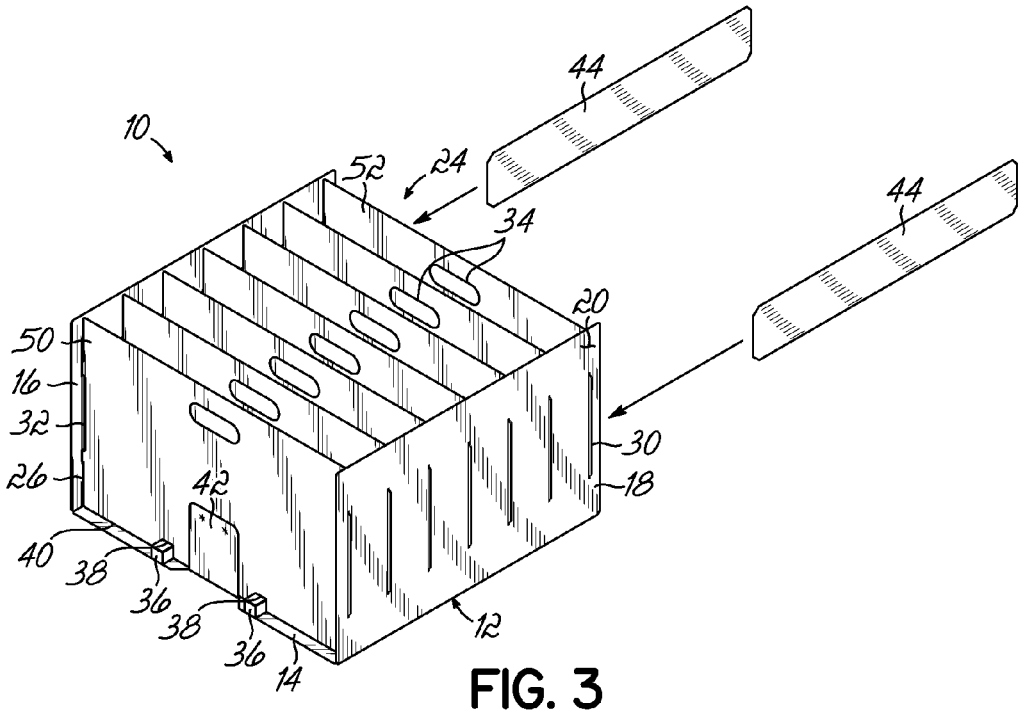
FIG. 3 is a perspective view of the container shown in FIGS. 1 and 2 showing the insertion of the locking strips through the tabs of the partitions.
Figure 4:
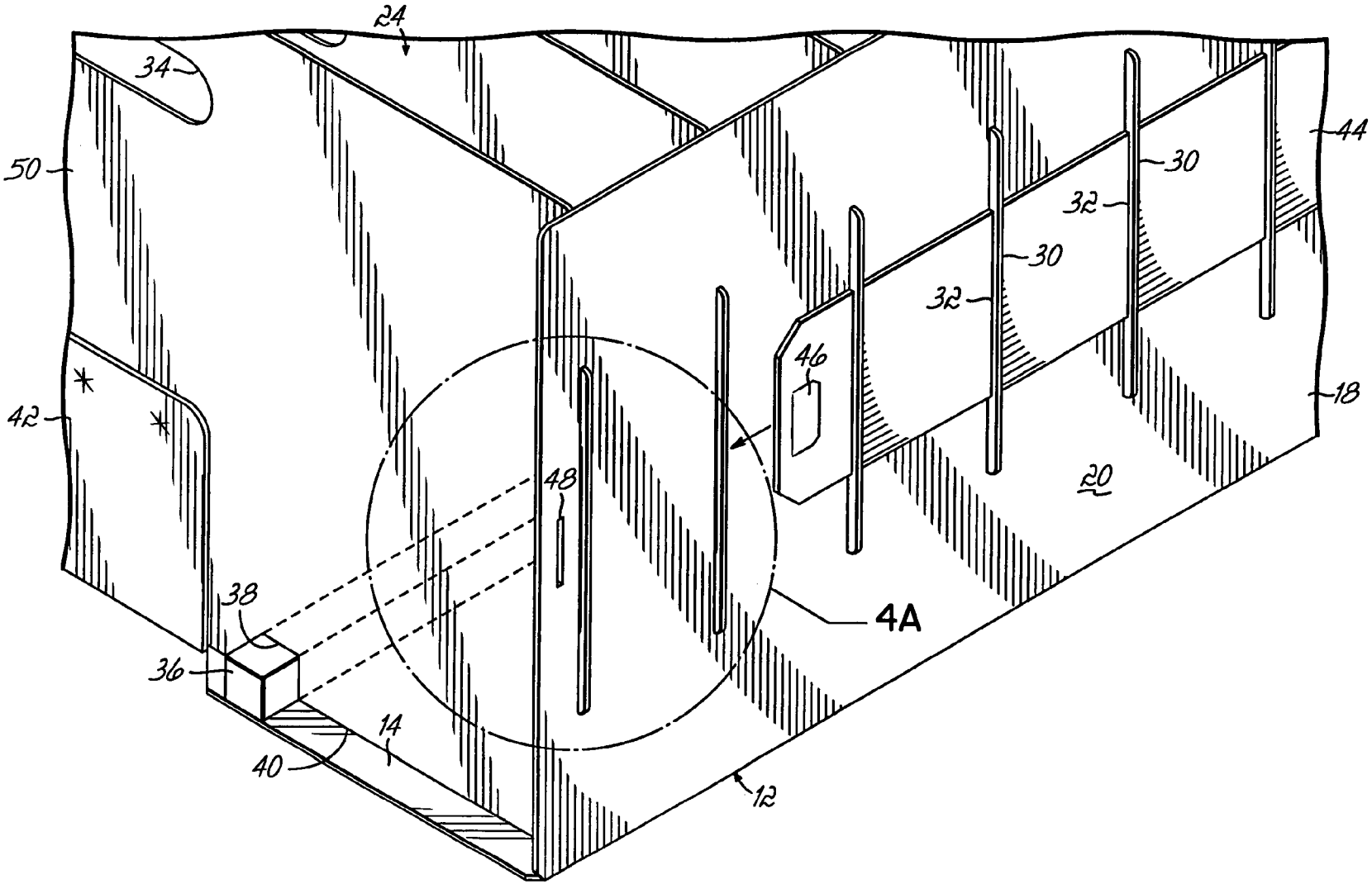
FIG. 4 is a detailed perspective view of the container shown in FIGS. 1-3 showing the insertion of the locking strip through slots in the tabs of the partitions.
Figure 4B:
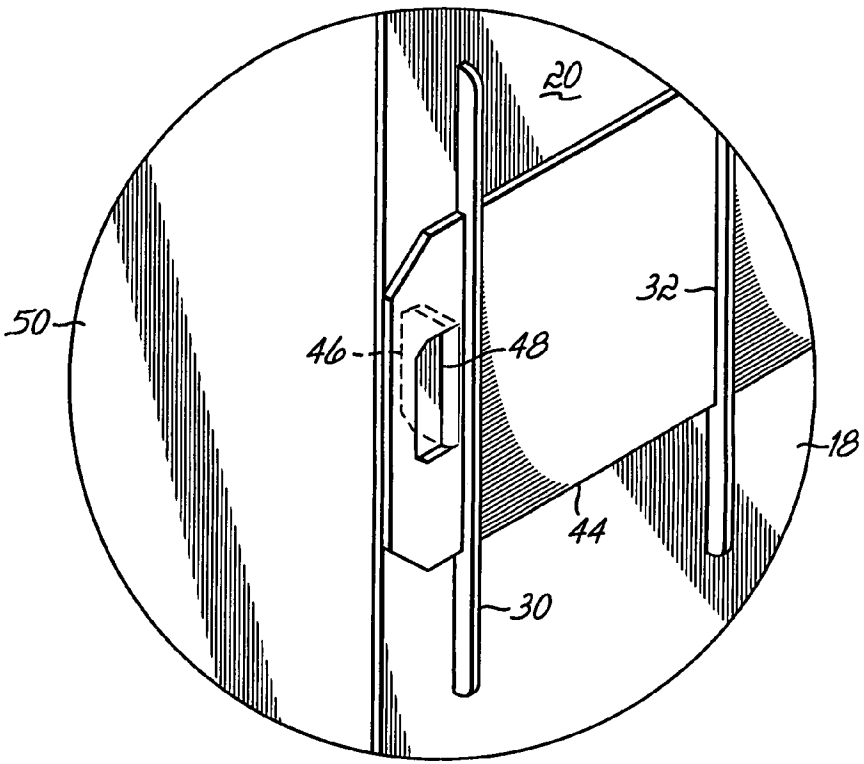
FIG. 4B is a detailed view, similar to FIG. 4A, showing an alternate embodiment where a locking member of a locking strip is oppositely hinged.
Figure 4A:
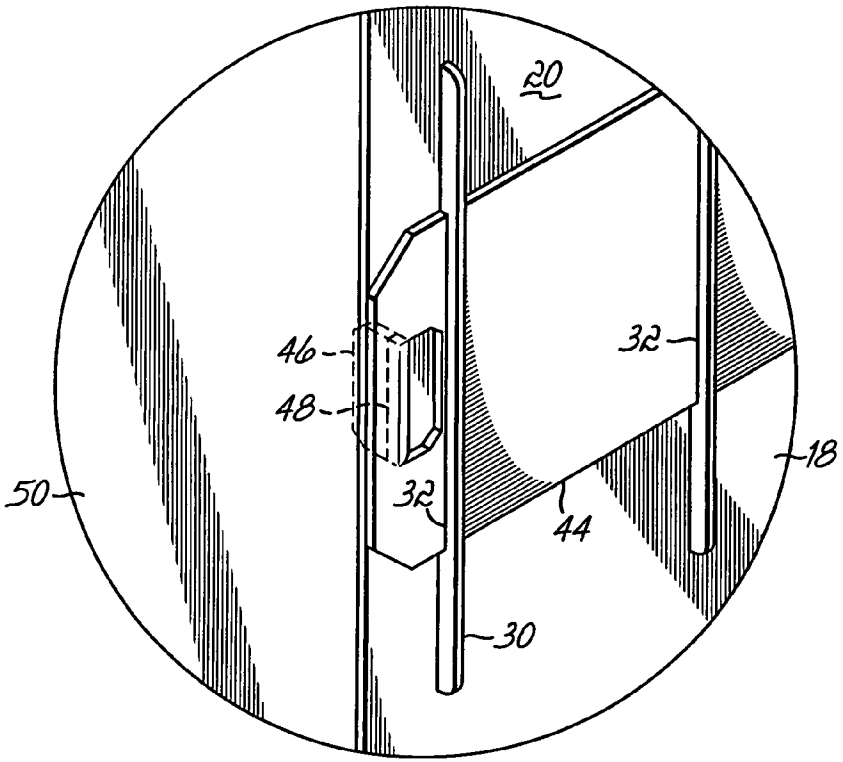
FIG. 4A is a detailed view of the encircled area of FIG. 4 showing the locking strip with a locking member extending through a locking aperture in a side wall of the container.

As shown in FIGS. 1 and 3, the container 10 further comprises a pair of locking strips 44. Each locking strip 44 is adapted to be inserted through the slots 32 in the tabs 30 of the partitions 24 when the tabs 30 of the partitions 24 have extended through the apertures 22 in the side walls 16, 18 of the container 10. As shown in FIG. 4, in one embodiment, each locking strip 44 may further comprise a locking tab or member 46 which is adapted to extend through a locking aperture 48 in one of the side walls 16, 18. As more particularly illustrated in FIGS. 4A and 4B, the locking member 46 may be either left or right hinged and is illustrated, extends through the locking aperture 48. Additionally, the locking member 46 may have the additional benefit of securing or providing additional stability to the first partition 50, as well as to the last partition 52 in the container 10 if a locking member 46 is used at both ends of the locking strip 44.

Figure 5:
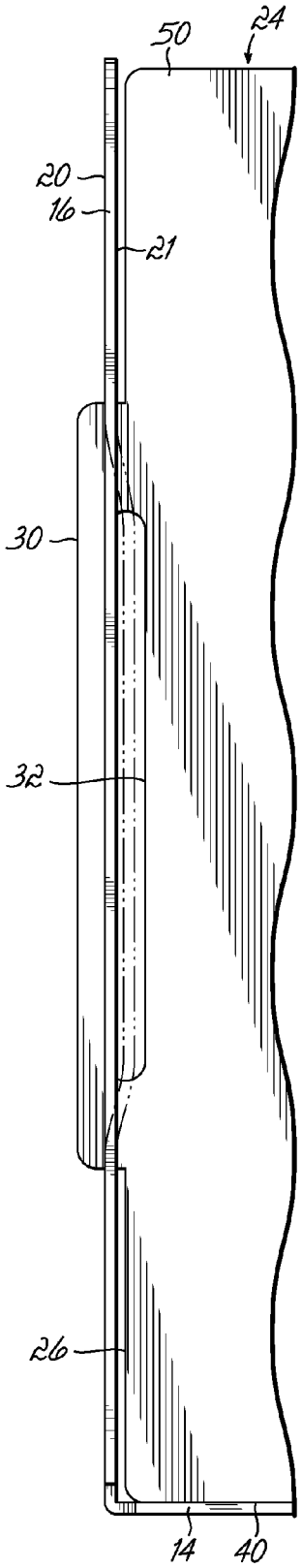
FIG. 5 is a partial front view of the container shown in FIG. 3 prior to the insertion of the locking strips.
Figure 6:
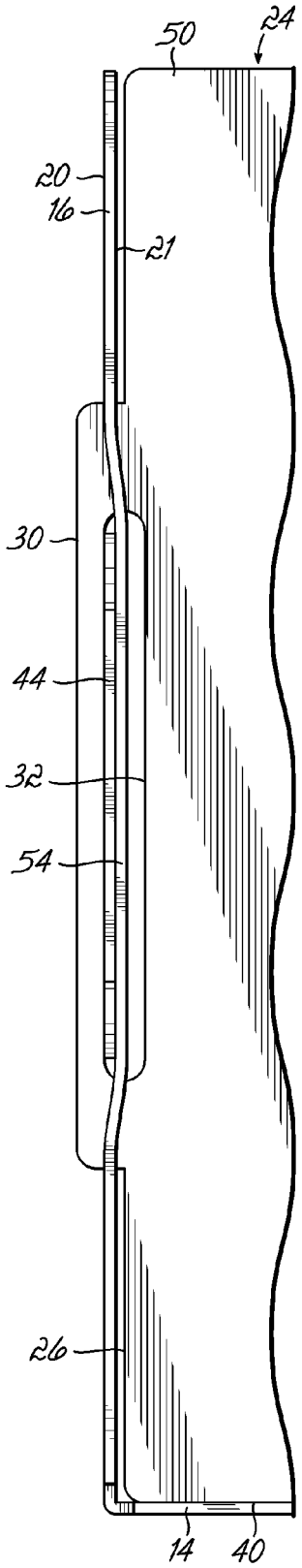
FIG. 6 is a partial front view of an alternative embodiment of container after locking strips have been inserted.

FIG. 5 illustrates an embodiment of the present invention where the side walls are inherently biased towards a planar orientation or position, yet are flexible enough, at least in a portion or area where the tabs 30 of the partitions 24 extend through the apertures 22 of the side walls 16, 18, to allow for the side wall 16, 18 to flex inwardly to allow for the insertion of the locking strip 44 between the exterior surface 20 of the side walls 16, 18 and the tab 30 as shown in FIG. 6. The planarly biased nature of the side walls 16, 18 in this particular embodiment, help to secure a locking strip 44 within the slots 32 of the tabs 30, and frictionally keep it sandwiched between the tab 30 and the exterior surface 20 of the side wall 16, 18. Those skilled in the art can appreciate that by varying the flexibility of the side walls 16, 18, various degrees of bias force may be obtained thereby providing various levels of securement of the locking strip 44 between the exterior surface 20 of the side walls 16, 18 and tabs 30.

As illustrated in FIG. 6, in an alternative embodiment, the side walls 16, 18 each contain a concave portion 54 which allows for the insertion of a locking strip 44 between the tab 30 and the exterior surface 20 of the side wall 16, 18. In either embodiment, whether the side walls 16, 18 flex or whether they are designed with a concave portion 54, the outside dimensions of the container 10 are minimized, thereby promoting efficiency in storage and shipping of multiple containers. The locking strips 44 may further be attached to or affixed to the side walls 16, 18 by staples, glue, heat bonding, or sonic welding. Such additional methods of attachment may be utilized separately, in combination, or in combination with, or without, the afore discussed locking members 46 and locking apertures 48 in the side walls 16, 18.

The container 10 of the present invention may be made by providing a blank made of corrugated plastic which can be hot wire bended to form a base member 14 and a pair of side walls 16, 18 extending upwardly therefrom. A plurality of partitions 24 can be placed between the side walls 16, 18 and the tabs 30 of those partitions inserted through apertures 22 in the side walls 16, 18. Thereafter, a locking strip 44 may be slid through the slots 32 in the tabs 30 and sandwiched between the exterior surface 20 of the side walls 16, 18 and the tabs 30. As discussed, the locking strips 44 may be further attached to the side walls via stapling, gluing, heating, sonic welding, or like method of affixture. Additionally, or in lieu of, the locking strips 44 may further be attached to the side walls 16, 18 via locking members 46 extending from the locking strip 44 through locking apertures 48 in the side walls 16 and 18.

In addition to the embodiments shown and described, the present invention may further contain other embodiments, for example, embodiments where more than one locking strip 44 is used on a particular side of a container 10. For example, in a container 10 having tall side walls 16, 18, it may be desirable to have a plurality of locking strips 44 versus the one locking strip 44 as shown in the drawings and described herein. Additionally, in such embodiments, it may be desirable to have different width locking strips 44 to provide for additional stability or rigidity of the container 10. Also, an additional locking strip 44 may be utilized on the bottom of the container 10 to provide further rigidity or support. Additionally, the apertures 22 in the side walls 16, 18 of multiple containers 10 may be staggered so that the tabs 30 that extend through the apertures 22 do not directly abut one another when like containers 10 are stacked next to one another. Finally, the containers 10 in the present invention may be comprised of cardboard, plastic, or like container material that those skilled in the art would recognize as adaptable to accomplishing the objectives of the present invention.

While the present invention has been illustrated by description of various embodiments and while these embodiments have been described in considerable detail, it is not the intention of the applicant to restrict or in any way limit the scope of the claims to such detail. Additional advantages and modifications will readily appear to those skilled in the art. The invention in its broader aspect is, therefore, not limited to the specific details, representative system, apparatus, and method, and illustrative example shown and described. Accordingly, departures may be made from such details without departing from the spirit or scope of the applicant's general inventive concept.

What is claimed is:

1. A container for holding product comprising:

a base;

side walls extending from the base, each side wall having a concave portion which bows inwardly toward the interior of the container and having a plurality of apertures therethrough;

a plurality of generally planar partitions positioned between the side walls, each partition having a first end with a tab and a second end with a tab, each tab having a slot and extending through one of the apertures in one of the side walls;

locking strips extending through the slots in the tabs and positioned in the concave portion of the side walls;

wherein the locking strips are sandwiched between an exterior surface of the side walls and the tabs to secure the partitions to the side walls.

2. The container of claim 1 wherein the locking strips are attached to the side walls.

3. The container of claim 1 wherein the locking strips are stapled to the side walls.

4. The container of claim 1 wherein the lacking strips are glued to the side walls.

5. The container of claim 1 wherein the locking strips are heat bonded to the side walls.

6. The container of claim 1 wherein the locking strips are sonically welded to the side walls.

7. The container of claim 1 further comprising:

a locking aperture in each of the side walls; and a locking member attached to each of the locking strips and adapted to extend through a locking aperture in a side wall.

8. A container for holding product comprising:

a base;

a pair of flexible side walls extending from the base, each flexible side wall being inherently biased towards a planar orientation and having an area containing a plurality of side wall apertures, the area of the side wall containing the side wall apertures being inwardly flexed, thereby creating a concave portion in the flexible side wall;

a plurality of generally planar partitions positioned between the flexible side walls, each partition having tabs, each of the tabs having a slot and extending through one of the side wall apertures;

locking strips extending through the slots in the tabs and positioned in the concave portions of the flexible side walls, each locking strip being sandwiched between an exterior surface of the flexible side wall and one of the tabs;

wherein the locking ships secure the partitions to the flexible side walls.

9. The container of claim 8 wherein the locking strips are attached to the flexible side walls.

10. The container of claim 8 wherein the locking strips are stapled to the flexible side walls.

11. The container of claim 8 wherein the locking strips are glued to the flexible side walls.

12. The container of claim 8 wherein the locking strips are heat bonded to the flexible side walls.

13. The container of claim 8 wherein the locking strips are sonic welded to the flexible side walls.

14. The container of claim 8 further comprising:

a locking aperture in each of the flexible side walls; and a locking member attached to each of the locking strips and adapted to extend through the locking apertures in the flexible side walls.

15. A method of making a container comprising:

providing a base member having a pair of side walls extending therefrom, each side wall having an exterior surface and a concave portion, the concave portion having a plurality of apertures;

positioning a plurality of generally planar partitions between the side walls, each partition having tabs, each tab having a slot therethrough;

inserting the tabs of the partitions through the apertures in the side walls; and sliding locking strips through the slots in the tabs whereby each locking strip is positioned between the concave portion of the side wall and an exterior portion of the tab.

16. The method of claim 15 further comprising the step of attaching the locking strip to the side walls.

17. The method of claim 15 further comprising the step of stapling the locking strips to the side walls.

18. The method of claim 15 further comprising the step of gluing the locking strips to the side walls.

19. The method of claim 15 further comprising the step of heat bonding the locking strips to the side walls.

20. The method of claim 15 further comprising the step of sonic welding the locking strips to the side walls.

21. The container of claim 15 further comprising the steps of:

providing a locking strip having locking member; and inserting the locking member into a side wall aperture.

22. A container for holding product comprising:

a generally U-shaped pad having a base and side walls extending upwardly from the base, each side wall having a concave portion which bows inwardly toward the interior of the container and having a plurality of apertures therethrough;

a plurality of generally planar partitions positioned between the side walls, each partition having a first end with a tab and a second end with a tab, each tab having a slot and extending through one of the apertures in one of the side walls;

locking strips extending through the slots in the tabs and positioned in the concave portion of the side walls;

wherein the locking strips are sandwiched between an exterior surface of the side walls and the tabs.

* * * * *